United States Patent [19]

DeForest

[11] 4,190,189

[45] Feb. 26, 1980

[54] CLOSURE MEMBER FOR A CONTAINER

[75] Inventor: Laurence R. DeForest, Kansas City, Mo.

[73] Assignee: Phillips Petroleum Co., Bartlesville, Okla.

[21] Appl. No.: 897,082

[22] Filed: Apr. 17, 1978

[51] Int. Cl.[2] ..... B65D 3/10

[52] U.S. Cl. ..... 229/5.6; 229/4.5; 229/5.5

[58] Field of Search ..... 229/4.5, 5.5, 43, 5.6

[56] References Cited

U.S. PATENT DOCUMENTS

| | | | |
|---|---|---|---|
| 2,141,556 | 12/1938 | Reifsnyder | 229/5.6 |
| 2,168,231 | 8/1939 | McLain et al. | 229/5.6 |
| 2,246,426 | 6/1941 | Wickstrom | 229/4.5 |
| 2,336,345 | 12/1943 | Carlson . | |
| 2,343,716 | 3/1944 | Toscano et al. | 229/5.6 |
| 2,438,430 | 3/1948 | Cosmo et al. | 229/5.6 |
| 2,458,737 | 1/1949 | Salkowitz . | |
| 3,137,432 | 6/1964 | Rein et al. | 229/5.6 |
| 3,322,318 | 5/1967 | Felton, Jr. et al. | 229/5.6 |
| 3,346,170 | 10/1967 | Carter | 229/43 X |
| 3,949,927 | 4/1976 | Smith et al. | 229/4.5 X |

*Primary Examiner*—Joseph Man-Fu Moy

[57] ABSTRACT

A closure member, for a container, formed from corrugated paperboard, plastic, or other similar substance is provided. The closure member increases the strength of the container and the rigidity of the container sidewalls. In a preferred embodiment of the invention the edges of the closure member are flattened and formed into a depending skirt. The edge of the container sidewall is then rolled over the depending skirt to form a sealed unit. In a second embodiment of the invention, in which the edge of the closure member is not flattened, the closure member is inserted into the container and the edge of the container sidewall is rolled to form a support for the closure member. The edge of the closure member is sealed to the container sidewall in this second embodiment.

10 Claims, 6 Drawing Figures

CLOSURE MEMBER FOR A CONTAINER

This invention relates to a closure member for a container. In a particular aspect this invention relates to a closure member, for a container, formed from corrugated paperboard, plastic or other similar material which provides greater strength to the container and greater rigidity to the sidewalls of the container. In a second particular aspect this invention relates to a closure member, for a container, formed from corrugated paperboard, plastic or other similar substance, having the edges thereof flattened to form a depending skirt which aids in sealing the closure member to the container sidewalls.

Containers formed from paperboard, plastic, or other similar materials are used in many diverse applications. The uses of such containers are, however, often limited by the strength of the containers. Conventional single layer closure members for such containers simply do not provide sufficient strength for many applications where it would be desirable to use containers formed of paperboard, plastic or other similar materials.

Accordingly, it is an object of this invention to provide a closure member for a container. It is a particular object of this invention to provide a closure member, for a container, formed from corrugated paperboard, plastic or other similar material which provides greater strength to the container and greater rigidity to the sidewalls of the container. It is a second particular object of this invention to provide a closure member, for a container, formed from corrugated paperboard, plastic or other similar substance, having the edges thereof flattened to form a depending skirt which aids in sealing the closure member to the container.

In accordance with the present invention a corrugated blank made of paperboard, plastic or other similar material is utilized to form a closure member for a container. In a preferred embodiment of the invention the outside portion of the corrugated blank is flattened and a depending skirt is formed. The edge of the container sidewall is then rolled around the depending skirt of the closure member to form a sealed unit. A fillet, which may be any type of hot melt adhesive or other suitable material, can be used to further seal the container sidewall to the closure member. A container formed in this manner will be much stronger than a container having a closure member formed from a single layer blank or even a closure member shaped in the form of a flat disc.

In a second embodiment of the invention, the edge of the container sidewall is rolled to form a support for the corrugated blank which has the same dimensions as the internal dimensions of the container. The edge of the corrugated blank is not crushed to form a depending skirt. The edge of the corrugated blank is sealed to the container sidewall, in this second embodiment, by means of a fillet which may be any type of hot melt adhesive or other suitable material. The second embodiment of the invention is not as strong as the preferred embodiment but has the advantage of simplicity while still providing a container having greater strength than a conventional container having a closure member formed from a single solid layer blank of the same weight.

Other objects and advantages of the invention will be apparent from the description of the invention and the appended claims thereto as well as from the detailed description of the drawings in which:

The invention is described in terms of a preferred embodiment and a second embodiment wherein the closure member is made of corrugated paperboard and is suitable for use with a container having a circular cross section transverse to its longitudinal axis, e.g. a frustoconical container or a cylindrical container. The applicability of the invention, however, extends to corrugated closure members made of other substances such as plastics and also extends to corrugated closure members suitable for use in containers having a shape other than cylindrical or frustoconical, e.g. oval transverse cross sections.

Figure 1:
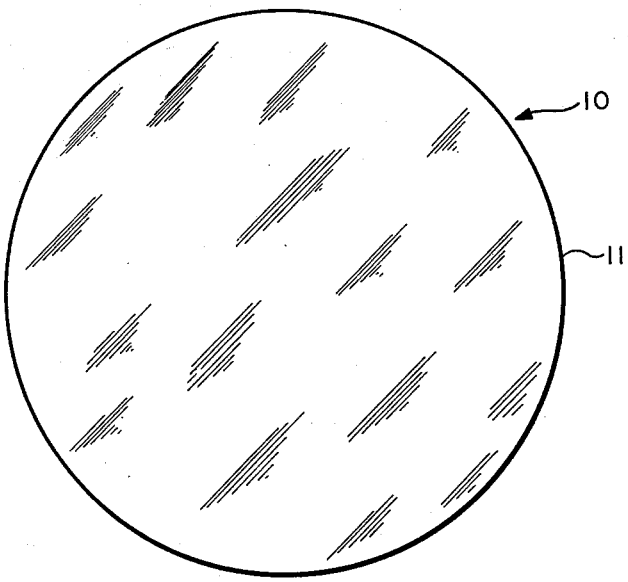
FIG. 1 is a top view of a corrugated blank.
Figure 2:
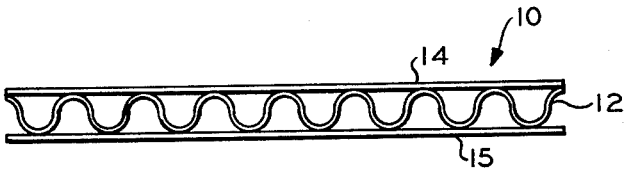
FIG. 2 is a side view of a corrugated blank.

Referring now to the drawings and in particular to FIG. 1, a corrugated circular blank 10 having an edge 11 is shown. As is shown in FIG. 2 the corrugated circular blank 10 has a corrugated paperboard center layer 12 bounded on opposite sides by upper layer paperboard member 14 and lower layer paperboard member 15. The corrugated paperboard center layer 12 can be bonded to members 14 and 15 at all points where contact is made to form what will be referred to as a corrugated paperboard blank. The corrugated paperboard blank can be up to about 0.125 inch (0.317 cm) in thickness. Upper layer member 14 is preferably provided with a coating of a polymeric thermoplastic material on the upper surface thereof, and lower layer member 15 is preferably provided with a coating of polymeric thermoplastic material on the lower surface thereof.

Figure 3:
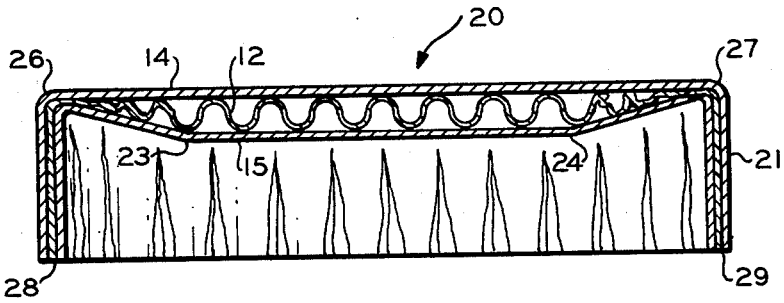
FIG. 3 is a diametrical cross-sectional view of a preform having the outside edges crushed to form a depending skirt.

A diagonal cross-sectional view of a preform 20 made from the corrugated paperboard blank 10, illustrated in FIGS. 1 and 2, is shown in FIG. 3. The corrugated paperboard center layer 12 and the upper and lower layer paperboard members 14 and 15 are as previously described in connection with FIG. 2. FIG. 3 is illustrative of a preferred embodiment of this invention in which the peripheral or annular marginal portion of the circular corrugated paperboard blank 10, illustrated in FIGS. 1 and 2, is flattened in such a manner that the corrugated paperboard center layer 12 is at least substantially crushed, and preferably is substantially totally crushed. The corrugated paperboard center layer 12 is progressively crushed in the annular area surrounding the circular portion having the diameter of the distance between points 23 and 24 until an approximate single layer is achieved at the edge of a circle having the diameter of the distance between points 26 and 27. The circular area located between points 26 and 27 will be referred to as the central portion of the closure member. The annular area located between inside points 26 and 28 and peripheral points 27 and 29 will be referred to as the flattened portion of the closure member. The flattened portion of the closure member can be bent at an angle to the central portion of the closure member to form a depending skirt 21 which extends completely around the periphery of the central portion of the closure member.

Figure 4:
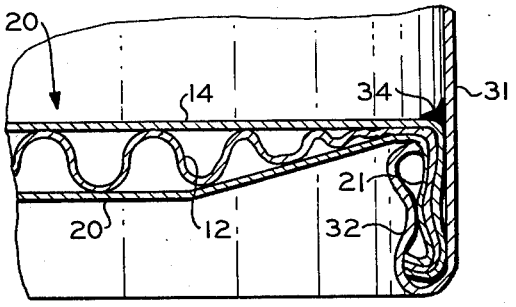
FIG. 4 is a partial cross-sectional view of the preform of FIG. 3 joined to the container sidewall in a preferred embodiment of the invention.

Referring now to FIG. 4, the depending skirt 21 can be utilized to secure the preform 20 to the sidewall 31 of a container having a circular cross section transverse to its longitudinal axis. The sidewall 31 is preferably provided with a coating of a polymeric thermoplastic material on the inner and outer surface thereof. The circular cross section of the container sidewall corresponds to the surface area of the portion of the upper layer member 14 which is included in the central portion of the preform 20. The preform 20 is inserted into a paperboard cylindrical container sidewall 31 and the marginal end portion 32 of the sidewall 31 is rolled or crimped over the depending skirt 21 of the preform 20. The end portion 32 of the sidewall 31 and the depending skirt 21 of preform 20 is crushed together to form a tight seal and may be adhesively bonded if desired. A fillet of sealing material 34 can be placed between the container sidewall 31 and the depending skirt 21 of the preform 20 to insure that the container will not leak. The fillet 34 may be any type of hot melt adhesive or other suitable material.

Figure 5:
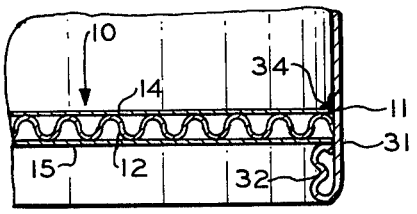
FIG. 5 is a partial cross-sectional view of the corrugated blank of FIGS. 1 and 2 joined to the container sidewall in a second embodiment of the invention.

In a second embodiment of the invention, illustrated in FIG. 5, the circular corrugated paperboard blank 10 is not crushed but is rather inserted into a container having a circular cross section transverse to its longitudinal axis in such a manner that the edge 11 of the corrugated paperboard blank 10 is in contact with the interior surface of the sidewall 31 of the cylindrical container. The marginal end portion 32 of the sidewall 31 of the cylindrical container can be rolled approximately 270°, at least, to provide suport for the circular corrugated paperboard blank 10. A fillet of sealing material 34 is placed in the corner formed by the junction of the single layer paperboard member 14 and the interior surface of the sidewall 31 of the cylindrical container. The fillet 34 will insure that the container will not leak and will help to keep the corrugated circular blank 10 in place.

Figure 6:
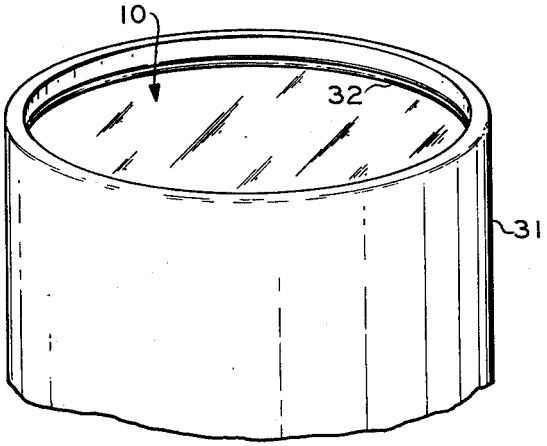
FIG. 6 is a partial pictorial view of a container formed in accordance with either the preferred embodiment or the second embodiment of the present invention. The view in FIG. 6 is identical for both embodiments of the invention.

FIG. 6 is a partial view in perspective of one end of a cylindrical container formed in the manner described in both the preferred embodiment and the second embodiment of this invention. FIG. 6 is presented to give an overall view of the appearance of the cylindrical container. The cylindrical container sidewall 31, the rolled and/or crimped marginal end portion 32 of the container sidewall 31, and the circular corrugated paperboard blank 10 are as previously described. It should be noted that the corrugated paperboard blank 10 may be in the form of preform 20, illustrated in FIG. 3 or the corrugated paperboard blank 10 may be unformed as is illustrated in FIG. 5.

The following example is presented in further illustration of the invention.

EXAMPLE

A round convolute single wrap container 5.125 inches (13.01 cm) high and having a 4.0 inch (10.16 cm) inside diameter was formed in the manner previously described. The corrugated paperboard closure member utilized was 0.125 inch (0.317 cm) thick with 50 flutes per inch (2.54 cm). The corrugated paperboard was double faced with 0.009 inch (0.022 cm) facings. The bottom facing was formed from bleached kraft board. A 0.250 inch (0.635 cm) depending skirt was formed in the corrugated paperboard closure member.

The sidewall of the container was made from 17 point (0.017 inch, 0.043 cm) single-ply bleached kraft paper coated on both sides with polyethylene. The bottom edge of the sidewall was rolled inward and crimped with the depending skirt of the corrugated bottom. The seam between the sidewall and the corrugated bottom was coated with a hot melt adhesive after the crimping operation was completed.

The container exhibited increased rigidity over containers of the same dimensions and structure but having a single ply bottom.

While the invention has been described in terms of the presently preferred embodiment and a variation thereof, other reasonable variations and modifications are possible, by those skilled in the art, within the scope of the described invention and the appended claims.

That which is claimed is:

1. A container structure comprising:

a corrugated closure member having a corrugated center layer bounded on opposite sides by inner and outer layer members, said corrugated closure member having a flattened peripheral marginal portion, said corrugated center layer being at least substantially crushed in said flattened peripheral marginal portion in such a manner that the crushed center layer is substantially in contact with said inner and said outer layer members, said flattened peripheral marginal portion being bent at an angle to the central portion of said corrugated closure member to form a depending skirt, the three plies formed by the crushed center layer substantially in contact with said inner and outer layer members extending at least from substantially the outer edge of said depending skirt to the angle formed between said flattened peripheral marginal portion and said central portion, said depending skirt extending completely around the periphery of said central portion;

a single-ply container sidewall formed so as to have a geometrical cross section, transverse to the longitudinal axis of said container structure, at least generally corresponding to the surface area of the portion of said inner layer member in said central portion of said corrugated closure member, said single-ply container sidewall forming an opening on the longitudinal axis of said container structure, said corrugated closure member being positioned within the opening formed by said single-ply container sidewall so as to generally fill the opening formed by said single-ply container sidewall, said single-ply container sidewall having a marginal end portion, said marginal end portion projecting beyond the edge of said depending skirt which is opposite said central portion of said closure member, said marginal end portion extending inwardly to form a rolled rim around said depending skirt with the edge of said marginal end portion extending at least generally to the bend between said depending skirt and said central portion of said closure member.

2. A container structure in accordance with claim 1 additionally comprising a fillet of sealing material at the general intersection of said inner layer of said corrugated closure member and said single ply container sidewall.

3. A container structure in accordance with claim 2 wherein said marginal end portion of said single ply container sidewall and said depending skirt of said corrugated closure member are bonded together.

4. A container structure in accordance with claim 3 wherein said surface area of the portion of said inner layer in said central portion of said corrugated closure member is circular and said geometrical cross section of said single ply container sidewall, transverse to the longitudinal axis of said container structure is circular.

5. A container structure in accordance with claim 4 wherein said rolled rim has at least 180° of curvature.

6. A container structure in accordance with claim 4 wherein said rolled rim has at least 270° of curvature.

7. A container structure in accordance with claim 1 wherein said marginal end portion of said single ply container sidewall and said depending skirt of said corrugated closure member are bonded together.

8. A container structure in accordance with claim 1 wherein said surface area of the portion of said inner layer in said central portion of said corrugated closure member is circular and said geometrical cross section of said single ply container sidewall, transverse to the longitudinal axis of said container, is circular.

9. A container structure in accordance with claim 1 wherein said rolled rim has at least 180° of curvature.

10. A container structure in accordance with claim 1 wherein said rolled rim has at least 270° of curvature.

* * * * *